United States Patent [19]

Cowell

[11] 4,170,122

[45] Oct. 9, 1979

[54] APPARATUS FOR MAKING CORRUGATED SHEET MATERIAL

[75] Inventor: Timothy A. T. Cowell, Canley, England

[73] Assignee: Covrad Limited, Canley, England

[21] Appl. No.: 877,628

[22] Filed: Feb. 14, 1978

[30] Foreign Application Priority Data

Feb. 17, 1977 [GB] United Kingdom ..... 06608/77

[51] Int. Cl.[2] ..... B21D 13/04

[52] U.S. Cl. ..... 72/186; 113/116 A; 428/596

[58] Field of Search ..... 72/186, 187; 113/116 A, 113/118 D; 29/6.1, 157.3 D, 160, 163.5 R; 264/286; 428/596, 597

[56] References Cited

U.S. PATENT DOCUMENTS

| | | | |
|---|---|---|---|
| 475,700 | 5/1892 | Ohl | 72/186 |
| 1,067,521 | 7/1913 | Jones | 29/6.1 |
| 1,455,061 | 5/1923 | Barrett | 264/286 |
| 3,083,662 | 4/1963 | Zeidler | 29/163.5 R |

*Primary Examiner*—Lowell A. Larson

*Attorney, Agent, or Firm*—Joseph P. House, Jr.

[57] ABSTRACT

Apparatus for making corrugated sheet material, primarily intended for use in heat exchangers as secondary heat exchange surfaces, includes a pair of rolls rotatable in opposite directions to draw sheet between the rolls.

The rolls are made up of laminae each with the same corrugated profile having teeth circumferentially spaced around the laminae. The teeth of each lamina are spaced from the teeth of adjacent laminae so that the sheet is sheared into interconnected strips each of corrugated form, the corrugations being displaced from one another in the longitudinal direction of the strips.

The corrugated material produced by the apparatus has improved heat exchange characteristics by virtue of the presentation to a flow of fluid over the material of a plurality of free edges of the material.

10 Claims, 8 Drawing Figures

APPARATUS FOR MAKING CORRUGATED SHEET MATERIAL

Figure 1:
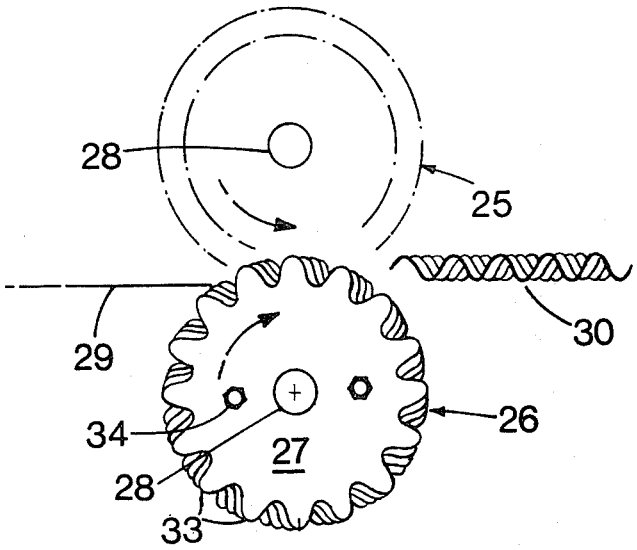

This invention relates to a method and apparatus for making corrugated sheet material and to the sheet material produced thereby.

It has already been proposed to use thin metal sheet or foil which has been formed into corrugations in heat exchangers, and to form such material with louvres to improve the heat exchange characteristics of the material. An example of such material is to be found in British Pat. No. 1,099,053. It has also been proposed to form corrugated material with alternate staggered portions so that the free edges of the portions are presented to the flow of fluid over the material when used in heat exchangers. A disclosure of such material is to be found in British Pat. No. 1,242,397.

An object of the invention is to provide an improved method of and apparatus for rapidly forming corrugated material which is particularly suitable for use in heat exchangers.

According to one aspect the invention provides apparatus for forming corrugated sheet material, comprising a pair of rolls and drive means for driving at least one of the rolls so that the rolls rotate in opposite directions, each roll being formed of a set of laminae arranged side by side along the axis of the associated roll and each lamina in a set having a corrugated profile with circumferentially spaced teeth, the teeth of adjacent laminae in a set being angularly displaced from one another about the axis of the associated roll, and the teeth of one set of laminae being arranged in mesh with the teeth of the other set of laminae; the rolls being so arranged that on feeding sheet material between the rolls corrugated sheet is formed which includes a unitary structure having a plurality of corrugated strips, each similarly shaped, and the corrugations in adjacent strips being displaced from one another in the longitudinal direction of the strips by an amount corresponding to said angular displacement of the laminae.

According to a further aspect the invention provides a method of forming corrugated sheet material, comprising the steps of continuously feeding sheet material between a pair of rolls, and driving the rolls in opposite directions by drive means in driving engagement with at least one of the rolls to draw the sheet through the rolls and form the sheet into a unitary structure including a plurality of strips each similarly shaped to provide corrugations, adjacent strips being arranged side by side, and the corrugations in adjacent strips being displaced from one another in the longitudinal direction of the strips, the rolls each being formed of a set of laminae arranged side by side along the axis of the associated roll and each lamina in a set having a corrugated profile with circumferentially spaced teeth, the teeth of adjacent laminae in a set being angularly displaced from one another about the axis of the associated roll by an amount corresponding to the desired displacement of the strips formed by the rolls.

The invention also provides corrugated sheet material produced by the method and/or apparatus of the invention.

Figure 2:
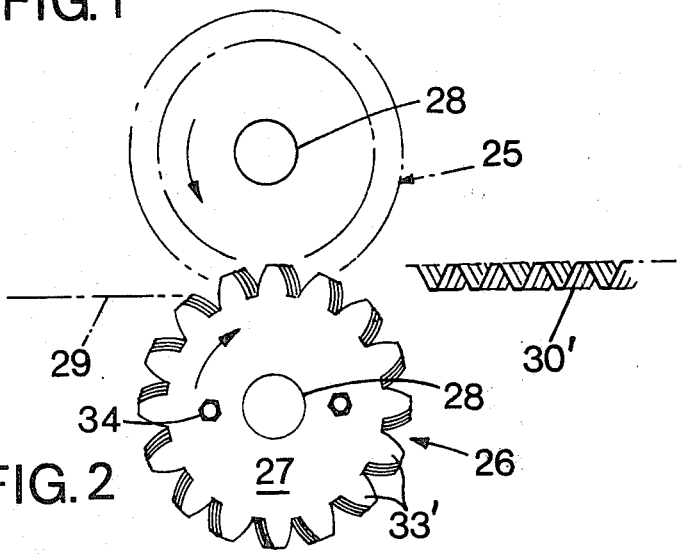
Figure 3:
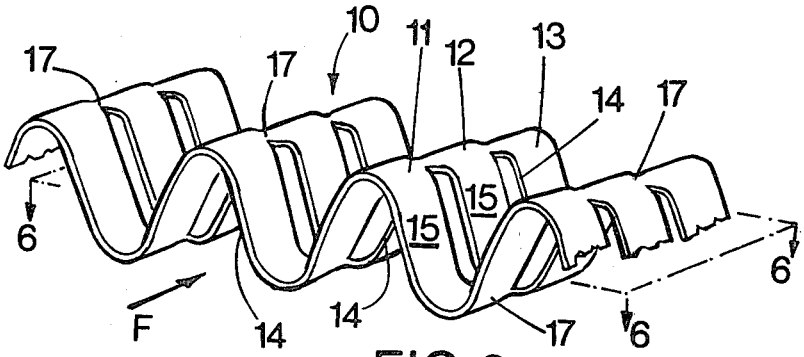
Figure 4:
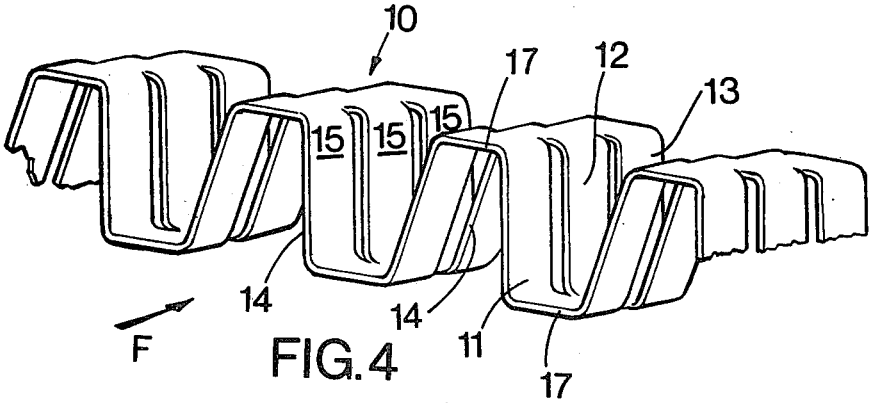
Figure 5:
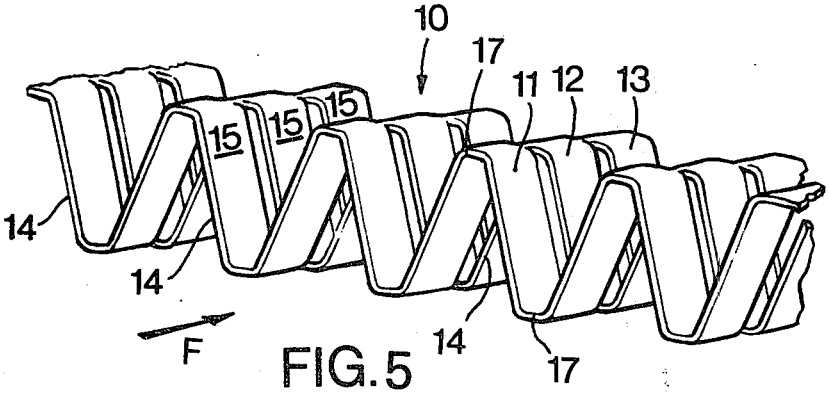
Figure 6:
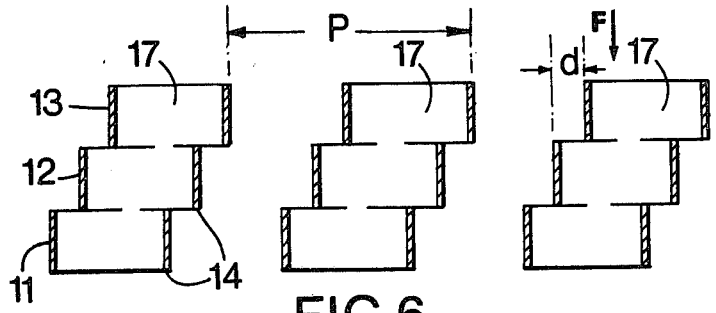
Figure 7:
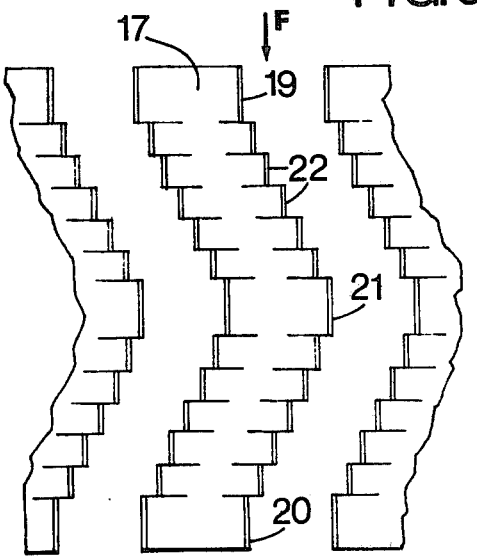
Figure 8:
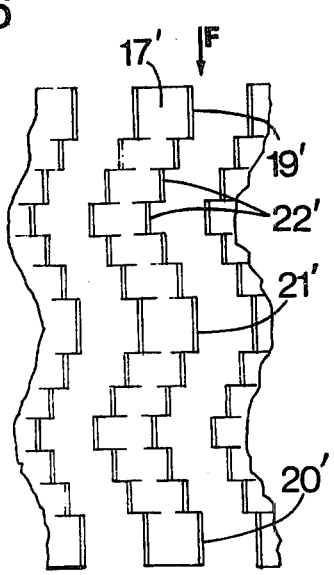

Further features of the invention appear from the following description given by way of example only and with reference to the drawings in which:

FIGS. 1 and 2 are side elevations of two embodiments of apparatus for forming corrugated sheet material, the tooth profile being different for each embodiment, FIG. 3 is a perspective view of corrugated sheet material formed by apparatus with the kind of tooth profile shown in FIG. 1, FIGS. 4 and 5 are perspective views of corrugated sheet material formed by apparatus with the kind of tooth profile shown in FIG. 2, FIG. 6 is a section on the line 6—6 in FIG. 3, and FIGS. 7 and 8 are sections corresponding to that of FIG. 6 of two further forms of corrugated sheet material.

Referring to the drawings, in which like parts are given the same reference numbers throughout the different embodiments, and firstly to FIGS. 1 and 2, apparatus for forming corrugated sheet material includes a pair of rolls 25 and 26. The rolls are mounted on parallel shafts 28 for rotation in opposite directions, one or both of the rolls being driven at substantially constant speed by drive means (not shown). Each roll 25,26 is made up of laminae 27 arranged side by side and in contact with one another and each lamina has an outer profile formed with circumferentially-spaced teeth 33,33' constituting a corrugated non re-entrant conjugate profile which is the same for all the laminae of a pair of rolls. Adjacent laminae 27 in each roll are angularly displaced from one another about the axis of the associated roll by a predetermined amount according to the desired form of the corrugated material. The laminae 27 may be of equal widths in the direction of the axis of the rolls or selected laminae may be wider than the others, for example, the end and the centre laminae may be of greater widths than the others.

The rolls 25 and 26 are arranged so that the teeth mesh together on rotation but are spaced sufficiently apart to provide a gap to admit a sheet 29 of sheet material between the peripheries of the rolls. As the rolls are rotated and the sheet 29 is fed continuously between the rolls, the sheet 29 is drawn between the rolls and is shared and shaped to form corrugated sheet material 30, 30'.

The profile of the teeth 33 of the apparatus of FIG. 1 is different from that of the teeth 33' of FIG. 2. The teeth 33 are of curvilinear, generally sinusoidal profile to form generally sinusoidal corrugations 30, whereas the teeth 33' have generally flat crests and troughs and curved intermediate flank portions of involute form to form corrugated material 30'.

The laminae 27 are keyed to the shaft 28 and are clamped together by through bolts 34.

The arrangement of the laminae axially of the shafts is preferably symmetrical to equalise the forces on the rolls and to ensure that the sheet 29 tends to remain central on the rolls.

The angular displacement between the laminae is such that the crests and troughs of the teeth of adjacent laminae are sufficiently close that the sheet material is not sheared off into separate strips but the strips are attached to one another at said crests and troughs. The corrugated material formed by the rolls thus has a unitary structure in which adjacent strips, corresponding to pairs of coacting laminae of a pair of rolls, are connected to one another at intervals along the strips.

Further constructional features of the rolls 25 and 26 will become apparent by reference to the following description of various forms of corrugated material which can be produced by the apparatus.

Referring now to FIGS. 3, 4, 5 and 6, sheet metal foil material 10 produced by the apparatus of the invention is made up of strips 11, 12, 13 of foil each of which is corrugated, the corrugations of FIGS. 3, 4 and 5 each being of different shape, as will be described, with each strip displaced in echelon from its adjacent strips in the longitudinal direction of the strips. In this way in use in a heat exchanger the edges 14 of the strips are directly exposed to a flow of fluid in a direction F over the strips and corresponding parts of the surfaces 15 of the strips are offset from one another in a direction at right angles to the length of the strips.

Adjacent strips are connected to one another adjacent each crest 17 of each strip so that the material 10 forms a unitary structure.

It will be seen that the arrangement of the sheet material of FIGS. 3, 4 and 5 only differs in relation to the form of the corrugations. Thus in FIG. 3 the corrugations are of sinusoidal form whereas in FIGS. 4 and 5 the corrugations are of truncated triangular form each with flat crests 17, the flattened portions of the crests being longer in the FIG. 4 embodiment compared with the FIG. 5 embodiment. The pitch of the corrugations is shown by P in FIG. 6.

It will be appreciated that although only three strips 11, 12 and 13 are shown in FIGS. 3 to 6 a unitary sheet will normally comprise a greater number of strips, corresponding to the number of laminae in the rolls 25 and 26, such as shown in FIGS. 7 and 8. In the case of the FIG. 7 embodiment thirteen strips are shown, the section being taken through the longitudinal central plane to show approximately two pitch lengths of the corrugations of each strip. In the case of FIG. 7 the displacement of each strip from its adjacent strip is the same and is equal to one fourteenth of the pitch of the corrugations and after seven strips the direction of the displacement is reversed. Moreover the end strips 19 and 20 and the centre strips 21 are wider than the remaining strips 22, which are all of the same width.

In the case of the FIG. 8 embodiment the section is taken through the longitudinal plane to show approximately two pitch lengths and in this arrangement the strips are displaced equally from one another by one eighth of the pitch of the corrugations. The direction of displacement is reversed three times over the width of the sheet. In this case strips 19', 20' and 21' are wider than the remaining strips 22' and the strips 21 and 21' may be relieved at their crests by slots or apertures to reduce any crimping in this region.

In the case of each of the embodiments the displacement of one strip from its adjacent strip or strips is determined by the displacement of the laminae 27.

By 'displacement' is meant the distance of a part of one strip from the corresponding part of another strip in a direction at right angles to the direction of flow F, for example, the distance d in FIG. 6. The displacement is related to the pitch length P of the corrugations and is generally in the range one sixth to one twentieth of the pitch length P.

In a preferred construction, the strips 22, 22', 18 have a width in the range of 1 mm to 2 mm, typically 1.5 mm; the thickness of the foil is between 0.05 mm to 0.1 mm, typically 0.07 mm, the overall depth between the opposite crests 17 of the corrugations is 3 to 10 mm, typically 5 mm; and the displacement between adjacent strips is 0.4 to 1.00 mm, typically 0.75 mm. The pitch length is between 4 mm and 8 mm, typically 6 mm. The displacement or stagger of the strips in relation to the pitch length is preferably between one sixth and one twentieth.

The corrugated material may be assembled with tubes (not shown) which are secured to the crests to each side of the material so as to be in heat exchange relationship with the material. The tubes may be arranged to extend along the relatively narrower strips, the wider strips, such as 19, 20 and 21 in FIG. 7 being located at the spaces between the tubes. As an alternative the tubes may occupy the entire width between the lateral sides of the corrugated material.

The assembly of corrugated material and tubes may find application in heat exchangers in which liquid passes along the tubes and air flows over the corrugated material acting as secondary heat exchange surfaces to cool or heat the liquid in the tubes. In this case the tubes may be connected to manifolds.

Although it has been described with reference to FIGS. 7 and 8 that the direction of displacement of the corrugated strip is reversed when the total displacement is nearly equal to half the pitch of the corrugations, it will be appreciated that in some cases reversal of the displacement may not take place at all or that the total displacement may exceed half the pitch of the corrugations before reversal.

Moreover before assembling the corrugated material in a heat exchanger, after formation of the corrugated material with the apparatus of FIGS. 1 and 2, the overall length of the material may be reduced by compression in the longitudinal direction of the strips and thus the relationship of the amount of displacement between adjacent strips and the pitch length of the corrugations may be altered. However this relationship, in the corrugated material to be assembled in a heat exchanger, may be above the previously mentioned figure of one sixth. Longitudinal compression may be used to derive generally rectangular corrugations from the corrugations of FIGS. 4 and 5.

The invention provides a method and apparatus which is capable of continuously and rapidly forming a length of corrugated sheet material from thin sheet material in a single operation, the sheet material being of a kind particularly suited for use in heat exchangers as a secondary heat exchange surface having good heat exchange characteristics. The apparatus and the method of its use is capable of simple adaptation to form a multiplicity of different forms of sheet material of which the present description and drawings only give a sample.

I claim:

1. Apparatus for forming corrugated sheet material for heat exchangers, comprising a pair of rolls, and drive means for driving at least one of the rolls so that the rolls rotate in opposite directions, each roll being formed of a set of laminae arranged side by side along the axis of the associated roll and each lamina in a set having a corrugated profile with circumferentially spaced teeth, the teeth of adjacent laminae in a set being angularly displaced from one another about the axis of the associated roll an amount no more than one sixth of the pitch of the teeth in the same angular sense, and the teeth of one set of laminae being arranged in mesh with the teeth of the other set of laminae; the rolls being so arranged that on feeding sheet material between the rolls, corrugated sheet is formed which includes a unitary structure including a plurality of corrugated strips preferably each being similarly shaped and the corrugations in adjacent strips being displaced from one another in the longitudinal direction of the strips by an amount corresponding to said angular displacement of the laminae so as to provide at least three strips which are offset from the preceding strip in the same direction.

2. Apparatus according to claim 1 wherein the teeth are of curvilinear form.

3. Apparatus according to claim 2 wherein the teeth are of substantially sinusoidal form.

4. Apparatus according to claim 1 wherein the flanks of the teeth are of involute form.

5. Corrugated sheet material formed by the apparatus of claim 1.

6. Apparatus according to claim 1 wherein the angular displacement of the teeth is in the range of one sixth to one twentieth of the pitch of the teeth.

7. Apparatus according to claim 1 wherein the angular displacement of adjacent laminae is such that adjacent strips of the corrugated material are attached to one another at the crests of the corrugations.

8. A method of forming corrugated sheet material for heat exchangers, comprising the steps of continuously feeding sheet material between a pair of rolls, and driving the rolls in opposite directions by drive means in driving engagement with at least one of the rolls to draw the sheet through the rolls and form the sheet into a unitary structure including a plurality of strips each preferably similarly shaped to provide corrugations, adjacent strips being arranged side by side, and the corrugations in adjacent strips being displaced from one another in the longitudinal direction of the strips so as to provide at least three strips which are each offset from the preceding strip in the same direction, the rolls each being formed of a set of laminae arranged side by side along the axis of the associated roll and each lamina in a set having a corrugated profile with circumferentially spaced teeth, the teeth of adjacent laminae in a set being angularly displaced from one another about the axis of the associated roll by an amount no more than one sixth of the pitch of the teeth in the same angular sense corresponding to the desired displacement of the strips formed by the rolls.

9. Corrugated sheet material formed by the method of claim 8.

10. Corrugated sheet material according to claim 9 comprising material of a thickness in the range of 0.05 mm to 0.1 mm.

* * * * *